US009469515B2

(12) United States Patent
Matsuo et al.

(10) Patent No.: US 9,469,515 B2
(45) Date of Patent: Oct. 18, 2016

(54) FORKLIFT HYDRAULIC CONTROL APPARATUS

(71) Applicant: KABUSHIKI KAISHA TOYOTA JIDOSHOKKI, Kariya-shi, Aichi-ken (JP)

(72) Inventors: Tsutomu Matsuo, Kariya (JP); Hirohiko Ishikawa, Kariya (JP); Yuki Ueda, Kariya (JP); Tetsuya Goto, Kariya (JP); Junichi Morita, Kariya (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 297 days.

(21) Appl. No.: 14/375,580

(22) PCT Filed: Jan. 16, 2013

(86) PCT No.: PCT/JP2013/050670

§ 371 (c)(1),
(2) Date: Jul. 30, 2014

(87) PCT Pub. No.: WO2013/114948

PCT Pub. Date: Aug. 8, 2013

(65) Prior Publication Data

US 2015/0013324 A1 Jan. 15, 2015

(30) Foreign Application Priority Data

Feb. 2, 2012 (JP) ..... 2012-021095

(51) Int. Cl.
*B66F 9/22* (2006.01)
*F15B 21/14* (2006.01)
(Continued)

(52) U.S. Cl.
CPC ..... *B66F 9/22* (2013.01); *F15B 11/02* (2013.01); *F15B 13/02* (2013.01); *F15B 21/14* (2013.01);
(Continued)

(58) Field of Classification Search
CPC ..... B66F 9/22; F15B 11/02; F15B 11/024; F15B 13/02; F15B 13/025; F15B 21/14; F15B 2011/0246; F15B 2211/3133; F15B 2211/6336; F15B 2211/20569; F15B 2211/761; F15B 2211/88
See application file for complete search history.

(56) References Cited

U.S. PATENT DOCUMENTS 5,649,422 A * 7/1997 Baginski ..... B66F 9/22 60/431
5,832,730 A 11/1998 Mizui
(Continued)

FOREIGN PATENT DOCUMENTS

CN 1203185 A 12/1998
CN 1219498 A 6/1999
(Continued)

OTHER PUBLICATIONS

Communication dated Aug. 28, 2015 from the European Patent Office in counterpart application No. 13744305.7.
(Continued)

*Primary Examiner* — Logan Kraft
(74) *Attorney, Agent, or Firm* — Sughrue Mion, PLLC

(57) ABSTRACT

An outlet port of a hydraulic pump/motor and a bottom chamber of a lift cylinder are connected to each other by a hydraulic fluid passage. A hydraulic fluid passage that is connected to a hydraulic fluid tank is formed to branch off the hydraulic fluid passage. A flow control valve controls the hydraulic fluid delivered from the lift cylinder when the fork is lowered, thereby regulating the flow rate of hydraulic fluid supplied to the hydraulic pump/motor and the flow rate of hydraulic fluid supplied to the hydraulic fluid tank. If regenerative operation can be performed, the flow control valve is closed and hydraulic fluid is delivered to the hydraulic pump/motor. If regenerative operation cannot be performed, the flow control valve is opened and hydraulic fluid is delivered to the hydraulic fluid tank. In either case, the fork can be lowered at an instructed speed.

6 Claims, 5 Drawing Sheets

(51) Int. Cl.
*F15B 11/02* (2006.01)
*F15B 13/02* (2006.01)

(52) U.S. Cl.
CPC ..... *F15B 2211/20569* (2013.01); *F15B 2211/6336* (2013.01); *F15B 2211/761* (2013.01); *F15B 2211/88* (2013.01)

(56) References Cited

U.S. PATENT DOCUMENTS

| | | | | |
|---|---|---|---|---|
| 6,092,976 | A | 7/2000 | Kamiya | |
| 6,164,415 | A | 12/2000 | Takeuchi et al. | |
| 6,308,516 | B1 | 10/2001 | Kamada | |
| 6,850,828 | B2 * | 2/2005 | Chen | B66F 9/22 701/50 |
| 2003/0167114 | A1 | 9/2003 | Chen | |
| 2006/0192519 | A1 | 8/2006 | Nakakita et al. | |

FOREIGN PATENT DOCUMENTS

| | | | |
|---|---|---|---|
| CN | 1231987 | A | 10/1999 |
| EP | 1695861 | A2 | 8/2006 |
| GB | 2360757 | A | 10/2001 |
| JP | 2-163300 | A | 6/1990 |
| JP | 2003-252592 | A | 9/2003 |
| JP | 2011-046499 | A | 3/2011 |
| JP | 2012-232815 | A | 11/2012 |

OTHER PUBLICATIONS

International Preliminary Report on Patentability dated Aug. 5, 2014 from the International Searching Authority in counterpart application No. PCT/JP2013/050670.

* cited by examiner

FORKLIFT HYDRAULIC CONTROL APPARATUS

CROSS REFERENCE TO RELATED APPLICATIONS

This is a National Stage of International Application No. PCT/JP2013/050670 filed Jan. 16, 2013, claiming priority based on Japanese Patent Application No. 2012-021095 filed Feb. 2, 2012, the contents of all of which are incorporated herein by reference in their entirety.

BACKGROUND OF THE INVENTION

The present invention relates to a hydraulic control apparatus for a forklift and, more particularly, to a hydraulic control apparatus for controlling a hydraulic cylinder.

A forklift carries out regenerative operation for driving a hydraulic pump/motor as a hydraulic motor by returning hydraulic fluid delivered from a lift cylinder to the hydraulic pump/motor at the time when the fork is lowered (see, for example, Patent Document 1).

PRIOR ART DOCUMENTS

Patent Documents

Patent Document 1: U.S. Pat. No. 5,649,422

SUMMARY OF THE INVENTION

A hydraulic pump/motor includes an inlet port for drawing hydraulic fluid from a fluid tank and an outlet port for discharging the drawn hydraulic fluid. As described in Patent Document 1, hydraulic fluid may be returned to the inlet port of a hydraulic pump/motor after having been delivered from a lift cylinder. In this case, the hydraulic control apparatus must be equipped with a hydraulic pump/motor capable of applying pressure to both the outlet port and the inlet port. This complicates the configuration of the hydraulic control apparatus.

Regenerative operation in a forklift is easily performed when the fork is lowered carrying a sufficiently heavy load. However, the regenerative operation is difficult to carry out when the fork is lowered carrying a light load. In this case, to lower the fork at an instructed speed, electricity is consumed to drive the hydraulic pump/motor. As a result, the regenerative operation only brings about insufficient effects.

Accordingly, it is an objective of the present invention to provide a hydraulic control apparatus for a forklift that has a simplified structure and ensures sufficient effects of regenerative operation.

To achieve the foregoing objective and in accordance with one aspect of the present invention, a hydraulic control apparatus is provide that is used in a forklift having a hydraulic lift cylinder that receives or discharges hydraulic fluid through manipulation of a raising/lowering manipulation member to selectively raise and lower a fork. The apparatus being includes a hydraulic pump/motor, a first fluid passage, an outflow control mechanism, a second fluid passage, and a flow control valve. The first fluid passage delivers hydraulic fluid delivered from the hydraulic lift cylinder to an outlet port of the hydraulic pump/motor when the fork is lowered. The outflow control mechanism is provided in the first fluid passage to permit flow of hydraulic fluid from the hydraulic lift cylinder to the hydraulic pump/motor at the time when the fork is lowered but prohibit the flow of hydraulic fluid from the hydraulic lift cylinder to the hydraulic pump/motor at the time when the fork is stopped or raised. The second fluid passage is branched from a section of the first fluid passage between the hydraulic pump/motor and the outflow control mechanism. The second fluid passage delivers hydraulic fluid delivered from the hydraulic lift cylinder to a drain side. The flow control valve is provided in the second fluid passage. The flow control valve controls the flow rate of the hydraulic fluid delivered from the hydraulic lift cylinder to the hydraulic pump/motor and the flow rate of the hydraulic fluid delivered from the hydraulic lift cylinder to the drain side.

According to this configuration, the hydraulic fluid delivered from the hydraulic lift cylinder is delivered to the outlet port of the hydraulic pump/motor. This simplifies the configuration of the hydraulic pump/motor. In other words, the configuration of the hydraulic control apparatus is simplified. Also, when the fork is lowered, regenerative operation is carried out by delivering the hydraulic fluid delivered from the hydraulic lift cylinder to the hydraulic pump/motor through the first fluid passage. When the flow rate of the hydraulic fluid flowing to the hydraulic pump/motor via the first fluid passage is insufficient for lowering the fork at the instructed speed, the flow control valve controls the flow rate in the first fluid passage and the flow rate in the second fluid passage such that the fork is lowered at the instructed speed. This makes it unnecessary to consume electricity to rotate the hydraulic pump/motor to lower the fork at the instructed speed. As a result, effects of the regenerative operation are ensured.

It is preferable that, if an actual rotation speed of the hydraulic pump/motor is short of a necessary rotation speed necessary for lowering the fork at an instructed speed corresponding to a manipulation amount of the raising/lowering manipulation member, the flow control valve delivers hydraulic fluid to the drain side at a flow rate corresponding to the shortage in the rotation speed. In this case, the flow control valve delivers the hydraulic fluid to the drain side at the flow rate corresponding to the shortage in the rotation speed. As a result, the fork is lowered at the instructed speed.

The hydraulic control apparatus for a forklift preferably includes a tilting hydraulic cylinder, a third fluid passage, an opening/closing mechanism, and a controller. The tilting hydraulic cylinder receives or discharges hydraulic fluid through manipulation of a tilting manipulation member to tilt a mast to which the fork is attached forward or rearward. The third fluid passage is connected to the outlet port of the hydraulic pump/motor. The third fluid passage delivers the hydraulic fluid discharged from the hydraulic pump/motor to the tilting hydraulic cylinder. The opening/closing mechanism is provided in a section of the first fluid passage between the hydraulic pump/motor and the outflow control mechanism. The opening/closing mechanism switches the first fluid passage between an open state for allowing hydraulic fluid to flow through the first fluid passage and a closed state for prohibiting hydraulic fluid from flowing through the first fluid passage. The controller controls a rotating electrical machine for driving the hydraulic pump/motor and controlling the opening/closing mechanism. When the fork is lowered through an independent operation, the controller controls the opening/closing mechanism to switch to the open state such that the hydraulic fluid delivered from the hydraulic lift cylinder drives the hydraulic pump/motor as a hydraulic motor to cause the rotating electrical machine to perform regenerative operation.

In this case, the hydraulic pump/motor supplies hydraulic fluid to the hydraulic lift cylinder and the tilting hydraulic cylinder. However, when the fork is lowered through the independent operation, the hydraulic pump/motor is driven by the hydraulic fluid delivered from the hydraulic lift cylinder, thus ensuring regenerative operation.

It is preferable that, when a simultaneous operation is performed in which the fork is lowered and the mast is tilted forward or rearward, the controller drives the rotating electrical machine based on a necessary rotation speed of the hydraulic pump/motor necessary for tilting at an instructed speed corresponding to a manipulation amount of the tilting manipulation member and controls the opening/closing mechanism to switch to the closed state. Also, the opening/closing mechanism in the closed state preferably causes the flow control valve to deliver the hydraulic fluid delivered from the hydraulic lift cylinder to the drain side.

In this case, when the simultaneous operation is carried out, the mast is tilted forward or rearward at the instructed speed corresponding to the manipulation amount of the tilting manipulation member by closing the first fluid passage with the opening/closing mechanism. Also, the fork is lowered at the instructed speed corresponding to the manipulation amount of the raising/lowering manipulation member by controlling the flow rate in the first fluid passage and the flow rate in the second fluid passage with the flow control valve. In other words, the fork and the mast are operated at the respective instructed speeds in the simultaneous operation.

The flow control valve preferably adjusts the opening degree thereof by difference between a pressure in a zone between the hydraulic lift cylinder and the outflow control mechanism and a pressure in a zone between the outflow control mechanism and the hydraulic pump/motor, thereby controlling the flow rate of the hydraulic fluid flowing to the drain side.

In this case, the flow control valve is selectively opened and closed depending on the pressure difference. This simplifies the configuration and the control of the hydraulic control apparatus compared with a case in which the opening degree of the flow control valve is electrically controlled.

Accordingly, the present invention simplifies the configuration of the hydraulic control apparatus and ensures effects of regenerative operation.

DETAILED DESCRIPTION OF THE PREFERRED EMBODIMENTS

First Embodiment

Figure 1:
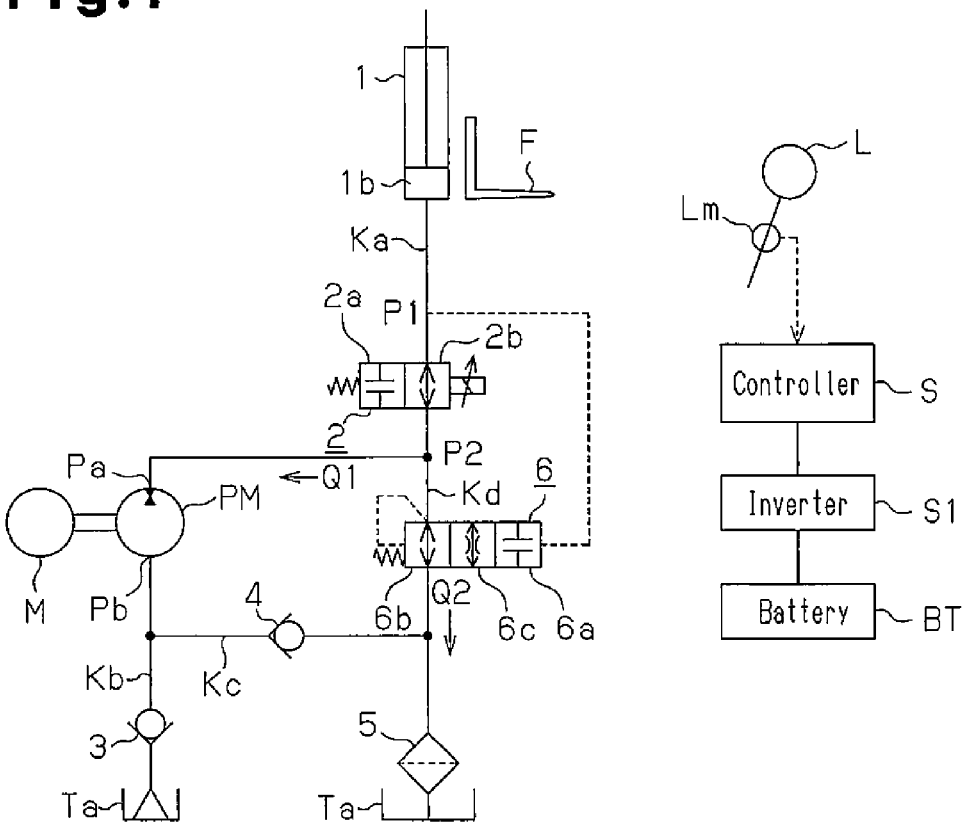
FIG. 1 is a circuit diagram representing a hydraulic control apparatus according to a first embodiment of the present invention.

A first embodiment of the present invention will now be described with reference to FIG. 1.

A forklift in the first embodiment is a picking forklift having a fork F, which serves as a loading attachment (a loading member) arranged at the front position of the forklift body and is selectively raised and lowered as instructed from the cab. Specifically, the fork F is selectively raised and lowered by means of a lift cylinder 1 serving as a hydraulic lift cylinder selectively extended and retracted through manipulation of a manipulation lever L, which is a raising/lowering manipulation member provided in the cab.

The hydraulic control apparatus of the first embodiment will hereafter be described.

The hydraulic control apparatus controls operation of the lift cylinder 1. The hydraulic control apparatus of the first embodiment configures an apparatus that is a hydraulic circuit for operating the lift cylinder 1 with a single pump and a single motor for driving the pump.

A motor (a rotating electrical machine) M functioning as an electric motor and an electricity generator is connected to a hydraulic pump/motor PM functioning as a hydraulic pump and a hydraulic motor. In the first embodiment, the motor M functions as an electric motor when the hydraulic pump/motor PM is operated as a hydraulic pump and as an electricity generator when the hydraulic pump/motor PM is operated as a hydraulic motor. The hydraulic pump/motor PM of the first embodiment is rotational in both of opposite directions.

A fluid passage Ka serving as a first fluid passage for supplying or delivering hydraulic fluid is connected to an outlet port Pa of the hydraulic pump/motor PM. The hydraulic pump/motor PM is connected to a bottom chamber 1*b* of the lift cylinder 1 via the fluid passage Ka. A raising/lowering proportional valve 2 is provided in the fluid passage Ka to control the flow rate of the hydraulic fluid flowing through the fluid passage Ka. The raising/lowering proportional valve 2 can be arranged at a first position 2*a*, which corresponds to a closed state prohibiting hydraulic fluid flow, and a second position 2*b*, which corresponds to an open state having an adjustable opening degree and allowing hydraulic fluid flow in opposite directions. The opening degree of the raising/lowering proportional valve 2 is controlled to regulate the flow rate of the hydraulic fluid flowing to the lift cylinder 1 when the fork F is raised. The opening degree of the raising/lowering proportional valve 2 is also adjusted to regulate the flow rate of the hydraulic fluid delivered to the hydraulic pump/motor PM when the fork F is lowered. In the first embodiment, when switched to the first position 2*a*, the raising/lowering proportional valve 2 blocks flow of hydraulic fluid from the bottom chamber 1*b* to the hydraulic pump/motor PM. In contrast, when arranged at the second position 2*b*, the raising/lowering proportional valve 2 permits hydraulic fluid flow from the bottom chamber 14*b* to the hydraulic pump/motor PM. The raising/lowering proportional valve 2 thus configures an outflow control mechanism.

A fluid passage Kb is connected to the inlet port Pb of the hydraulic pump/motor PM to deliver the hydraulic fluid drawn from the fluid tank Ta to the hydraulic pump/motor PM when the hydraulic pump/motor PM operates as a hydraulic pump. A check valve 3 for allowing hydraulic fluid to flow from the hydraulic tank Ta to the hydraulic pump/motor PM is arranged in the fluid passage Kb. A fluid passage Kc is connected to the inlet port Pb of the hydraulic pump/motor PM to deliver the hydraulic fluid that has been drawn from the outlet port Pa and discharged from the inlet port Pb (as returned hydraulic fluid) to the fluid tank Ta when the hydraulic pump/motor PM operates as a hydraulic motor. A check valve 4 for allowing hydraulic fluid flow from the hydraulic pump/motor PM to the fluid tank Ta is provided in the fluid passage Kc. The returned hydraulic fluid is delivered to the hydraulic tank Ta through a filter 5.

As illustrated in FIG. 1, in the first embodiment, the hydraulic fluid delivered from the bottom chamber 1*b* of the lift cylinder 1 flows into the outlet port Pa of the hydraulic pump/motor PM via the fluid passage Ka. The fluid passage Kb, which is connected to the inlet port Pb of the hydraulic pump/motor PM, thus does not receive pressure. As a result, the hydraulic pump/motor PM does not have to be configured to receive pressure on both the outlet port Pa and the inlet port Pb. In other words, the hydraulic pump/motor PM only needs to be configured to receive pressure on the outlet port Pa and does not have to be capable of receiving pressure on the inlet port Pb. As a result, the hydraulic pump/motor PM of the hydraulic control apparatus of the first embodiment is configured to receive pressure only on the outlet port Pa.

A bypass fluid passage Kd serving as a second fluid passage, which is branched from the fluid passage Ka and connected to the fluid tank Ta (a drain side), is connected to the fluid outlet side of the raising/lowering proportional valve 2. A flow control valve 6 for controlling the flow rate of the hydraulic fluid flowing through the bypass fluid passage Kd is arranged in the bypass fluid passage Kd. In the first embodiment, the flow control valve 6 is arranged between the raising/lowering proportional valve 2 and the fluid tank Ta. The flow control valve 6 may be arranged at a first position 6*a* as a fully closed state, a second position 6*b* as a fully open state, and a third position 6*c* as an open state with an adjustable opening degree. In the first embodiment, the flow control valve 6 is switchable among the first position 6*a*, the second position 6*b*, and the third position 6*c* depending on the difference between a pressure P1 acting in the zone between the lift cylinder 1 and the raising/lowering proportional valve 2 and a pressure P2 acting in the zone between the raising/lowering proportional valve 2 and the hydraulic pump/motor PM.

Specifically, the flow control valve 6 operates to decrease the opening degree of the flow control valve 6 as the difference between the pressure P1 and the pressure P2 increases and increase the opening degree as the aforementioned pressure difference decreases. As a result, when the flow control valve 6 is arranged at the first position 6*a*, the hydraulic fluid delivered from the bottom chamber 1*b* of the lift cylinder 1 flows to the outlet port Pa of the hydraulic pump/motor PM through the raising/lowering proportional valve 2. In other words, in this case, the full amount of the hydraulic fluid that has passed through the raising/lowering proportional valve 2 flows to the outlet port Pa of the hydraulic pump/motor PM at a flow rate Q1 represented in FIG. 1. In contrast, when the flow control valve 6 is arranged at either the second position 6*b* or the third position 6*c*, the hydraulic fluid delivered from the bottom chamber 1*b* of the lift cylinder 1 flows to the outlet port Pa of the hydraulic pump/motor PM and the fluid tank Ta through the raising/lowering proportional valve 2. That is, in this case, the hydraulic fluid that has passed through the raising/lowering proportional valve 2 is delivered to the outlet port Pa of the hydraulic pump/motor PM at the flow rate Q1 of FIG. 1 and to the fluid tank Ta at a flow rate Q2 represented in FIG. 1. The flow control valve 6 is adjusted in advance to open at a desirable opening degree in correspondence with the pressure difference.

The configuration of a controller S of the hydraulic control apparatus will now be described.

A potentiometer Lm for detecting the manipulation amount of the manipulation lever L is connected to the controller S. The controller S controls rotation of the motor M and regulates the opening degree of the raising/lowering proportional valve 2 with reference to a detection signal provided by the potentiometer Lm based on the manipulation amount of the manipulation lever L.

An inverter S1 is electrically connected to the controller S. A battery BT supplies electricity to the motor M through the inverter S1. Electricity produced by the motor M is stored in the battery BT through the inverter S1. In the first embodiment, the forklift is driven by the electricity stored in the battery BT, which is a drive source.

Operations of the hydraulic control apparatus according to the present embodiment will now be described.

The hydraulic control apparatus operates in the manner described below to raise the fork F.

To raise the fork F, hydraulic fluid is supplied to the bottom chamber 1*b* of the lift cylinder 1. For such fluid supply, the controller S calculates the necessary rotation speed of the hydraulic pump/motor PM and the opening degree of the raising/lowering proportional valve 2 that are necessary for raising the fork F at the instructed speed corresponding to the manipulation amount of the manipulation lever L. The controller S then controls operation of the motor M at the calculated necessary rotation speed as the instructed rotation speed of the motor M and opens the raising/lowering proportional valve 2 at the second position 2*b* by the calculated opening degree.

In this manner, the hydraulic pump/motor PM functions as a hydraulic pump through rotation of the motor M, thus drawing hydraulic fluid from the fluid tank Ta and discharging the hydraulic fluid from the outlet port Pa. The hydraulic fluid then flows through the fluid passage Ka and is supplied to the bottom chamber 1*b* of the lift cylinder 1 through the raising/lowering proportional valve 2. This extends the lift cylinder 1, thus raising the fork F. To end fork raising, the controller S stops the motor M and switches the raising/lowering proportional valve 2 to the first position 2*a*.

The control apparatus operates in the manner described below to lower the fork F.

To lower the fork F, hydraulic fluid is delivered from the bottom chamber 1*b* of the lift cylinder 1. For such fluid delivery, the controller S calculates the necessary rotation speed of the hydraulic pump/motor PM and the opening degree of the raising/lowering proportional valve 2 that are necessary for lowering the fork F at the instructed speed corresponding to the manipulation amount of the manipulation lever L. The controller S then controls operation of the motor M at the calculated necessary rotation speed as the instructed rotation speed of the motor M and opens the raising/lowering proportional valve 2 at the second position 2*b* by the calculated opening degree.

When the raising/lowering proportional valve 2 is open, the hydraulic fluid delivered from the bottom chamber 1*b* of the lift cylinder 1 flows into the outlet port Pa of the hydraulic pump/motor PM via the fluid passage Ka. At this stage, if the hydraulic pump/motor PM is driven at the instructed rotation speed by the hydraulic fluid delivery from the bottom chamber 1*b* as the drive force, the motor M outputs negative torque and thus performs regenerative operation. In other words, the motor M is caused to function as an electricity generator by the hydraulic pump/motor PM functioning as a hydraulic motor. The electricity generated by the motor M operating as an electricity generator is stored in the battery BT through the inverter S1. To end fork lowering, the controller S stops the motor M and switches the raising/lowering proportional valve 2 to the first position 2*a*.

Such regenerative operation is carried out when the fork F is lowered while carrying a sufficiently heavy load. In other words, in this case of fork lowering, the weight of the fork F and the weight of the load facilitate delivery of the hydraulic fluid from the bottom chamber 1*b*. The hydraulic fluid thus flows into the outlet port Pa of the hydraulic pump/motor PM in correspondence with the opening degree of the raising/lowering proportional valve 2 at the flow rate necessary for lowering the fork F at the instructed speed corresponding to the manipulation amount of the manipulation lever L. As a result, without powering operation of the motor M, the hydraulic pump/motor M is operated at the necessary rotation speed necessary for fork lowering at the instructed speed corresponding to the manipulation amount of the manipulation lever L, which is the instructed rotation speed. In the regenerative operation, the fork lowering speed is controlled by adjusting the opening degree of the raising/lowering proportional valve 2.

The flow control valve 6 may be arranged in either a closed state or an open state by a desired opening degree in correspondence with the difference between the pressure P1 and the pressure P2. In the first embodiment, when the raising/lowering proportional valve 2 is arranged at the first position 2*a* and thus is not performing fork lowering, the flow control valve 6 is set in the closed state (at the first position 6*a*) based on the difference between the pressure P1 and the pressure P2 (P1>P2). When the raising/lowering proportional valve 2 is set in the open state (at the second position 2*b*) and the hydraulic fluid starts to flow through the raising/lowering proportional valve 2, the difference between the pressure P1 and the pressure P2 decreases, thus switching the flow control valve 6 to the open state. At this stage, the hydraulic fluid flows to the hydraulic pump/motor PM via the fluid passage Ka (at the flow rate Q1 represented in FIG. 1) and flows to the fluid tank Ta (the drain side) through the fluid passage Kd at the flow rate corresponding to the opening degree of the flow control valve 6 (at the flow rate Q2 represented in FIG. 1). Then, as the rotation speed of the hydraulic pump/motor PM increases, the difference between the pressure P1 and the pressure P2 increases such that the flow control valve 6 is returned to the closed state. At this stage, the hydraulic fluid flows only to the hydraulic pump/motor PM through the fluid passage Ka (at the flow rate Q1 represented in FIG. 1).

If, unlike when the regenerative operation is performed, it is impossible to control the fork lowering speed to be equal to the instructed speed through adjustment of the opening degree of the raising/lowering proportional valve 2, the flow control valve 6 is opened by a desired opening degree to achieve the instructed speed.

If fork lowering is performed with a light load mounted on the fork F, delivery of hydraulic fluid from the bottom chamber 1*b* is not facilitated only by the weight of the fork F and the weight of the load. That is, the hydraulic fluid cannot be easily delivered to the outlet port Pa of the hydraulic pump/motor PM at the flow rate necessary for fork lowering at the instructed speed corresponding to the manipulation amount of the manipulation lever L. Accordingly, to drive the hydraulic pump/motor PM at the instructed rotation speed to achieve the instructed fork lowering speed, powering operation of the motor M must be performed. However, the powering operation of the motor M consumes electricity. In this case, the controller S of the first embodiment restricts the rotation speed of the motor M. Specifically, the controller S drives the motor M by the upper limit rotation speed that allows operation of the motor M as the electricity generator. Through such restriction of the rotation speed of the motor M, the rotation speed of the motor M decreases. The flow rate thus becomes short of the value necessary for fork lowering at the instructed speed. However, the flow control valve 6 operates to compensate for the shortage in the flow rate.

In other words, as the flow rate of the hydraulic fluid delivered to the hydraulic pump/motor PM decreases, the pressure P2 rises such that the difference between pressure P1 and the pressure P2 decreases. This switches the flow control valve 6 to the open state. In this manner, the hydraulic fluid delivered from the lift cylinder 1 is delivered to the hydraulic pump/motor PM by the corresponding flow rate (the flow rate Q1 represented in FIG. 1) and to the fluid tank Ta (the drain side) through the flow control valve 6 by the corresponding flow rate (the flow rate Q2 represented in FIG. 1). That is, by opening the fluid passage Kd, which is a hydraulic fluid passage, by means of the flow control valve 6, the shortage in the flow rate is compensated for. The instructed fork lowering speed is thus achieved. As has been described, when fork lowering is performed without regenerative operation, the hydraulic control apparatus saves electricity consumption through operation of the motor M and operation of the flow control valve 6 and achieves the instructed fork lowering speed.

The first embodiment has the advantages described below.

(1) Since the hydraulic fluid delivered from the lift cylinder 1 is delivered to the outlet port Pa of the hydraulic pump/motor PM, the fluid passage Kb (the zone between the hydraulic pump/motor PM and the tank Ta) does not receive pressure. Accordingly, the hydraulic pump/motor PM only needs to be configured to receive pressure on the outlet port Pa of the hydraulic pump/motor PM. This simplifies the configuration of the hydraulic pump/motor PM, thus also simplifying the configuration of the hydraulic control apparatus.

(2) When the flow rate of the hydraulic fluid flowing into the hydraulic pump/motor PM is insufficient for lowering the fork F at the instructed speed, the flow control valve 6 controls the flow rate in the fluid passage Ka and the flow rate in the fluid passage Kd to lower the fork F at the instructed speed. This makes it unnecessary to consume electricity to drive the hydraulic pump/motor PM to lower the fork F at the instructed speed, thus ensuring effects of regenerative operation. In other words, the electricity obtained through the regenerative operation is effectively used without being consumed to lower the fork F.

(3) Since the flow control valve 6 is selectively opened and closed depending on the pressure difference, the configuration and the control of the hydraulic control apparatus are simplified compared with a case in which the opening degree of the flow control valve 6 is electrically controlled.

(4) Since the flow rate in the fluid passage Kd is continuously switchable by means of the flow control valve 6, switching the flow rate is unlikely to cause chattering or impact.

(5) The flow control valve 6 is arranged in parallel with the passage extending between the lift cylinder 1 and the hydraulic pump/motor PM. This arrangement decreases pressure loss and thus ensures highly efficient regenerative operation.

Second Embodiment

Figure 2:
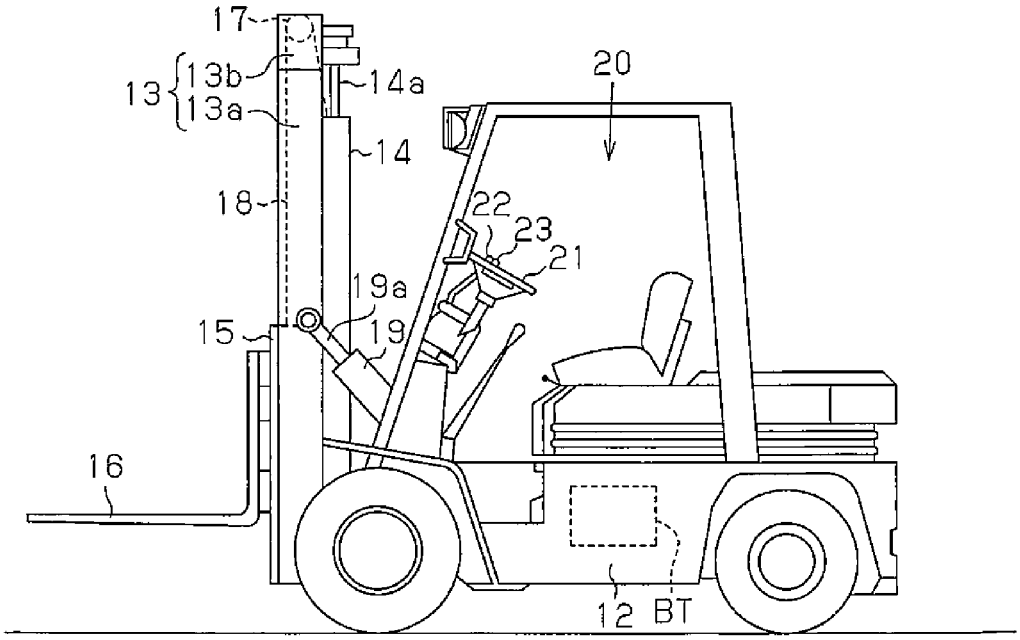
FIG. 2 is a side view showing a forklift according to a second embodiment of the invention.

A second embodiment of the present invention will now be described with reference to FIGS. 2 and 3.

In the embodiments described below, like or the same reference numerals are given to those components that are like or the same as the corresponding components of the already described embodiment, and overlapped explanations are omitted or simplified.

A forklift of the second embodiment is a counterbalance forklift. As illustrated in FIG. 2, the forklift includes a mast 13 arranged in a front portion of a body frame 12. The mast 13 includes a pair of, left and right, outer mast portions 13*a*, which are pivotally supported by the body frame 12, and corresponding inner mast portions 13*b*, which are mounted on the inner sides of the outer mast portions 13*a* in an ascendable/descendable manner. A lift cylinder 14 serving as a hydraulic lift cylinder is fixed to the rear side of each of the outer mast portions 13*a* and extends parallel to the outer mast portion 13*a*. A piton rod 14*a* of the lift cylinder 14 has a distal end connected to an upper portion of the corresponding inner mast portion 13*b*.

A lift bracket 15 is mounted on the inner sides of the inner mast portions 13*b* in a manner ascendable/descendable along the inner mast portions 13*b*. A fork 16 serving as a loading member is attached to the lift bracket 15. A chain wheel 17 is supported by the upper portion of each inner mast portion 13*b* and a chain 18 is wound around the chain wheel 17. A first end portion of the chain 18 is connected to an upper portion of the corresponding lift cylinder 14 and a second end portion of the chain 18 is connected to the lift bracket 15. The lift cylinders 14 are extended or retracted to raise or lower the fork 16, together with the lift bracket 15, through the chain 18.

Left and right tilt cylinders 19 each serving as a tilting hydraulic cylinder are supported on opposite lateral sides of the body frame 12 in a manner pivotal at the basal ends of the tilt cylinders 19. The distal end of a piston rod 19*a* of each tilt cylinder 19 is pivotally connected substantially to a middle portion of the corresponding outer mast portion 13*a* in the upward-downward direction. The tilt cylinders 19 are extended or retracted to tilt the mast 13.

A steering wheel 21, a lift lever 22 serving as a raising/lowering manipulation member, and a tilt lever 23 serving as a tilting manipulation member are arranged in a front portion of a cab 20. The lift lever 22 is manipulated to selectively extend and retract the lift cylinders 14 to raise or lower the fork 16. The tilt lever 23 is manipulated to selectively extend and retract the tilt cylinders 19 to tilt the mast 13.

The mast 13 is pivotal in a range from a predetermined rearmost tilt position to a predetermined foremost tilt position. The mast 13 illustrated in FIG. 2 is arranged upright. If the mast 13 tilts toward the cab 20, such tilting is referred to as rearward tilting. If the mast 13 tilts away from the cab 20, such tilting is referred to as forward tilting. In the forklift of the second embodiment, the mast 13 tilts forward when the tilt cylinders 19 are extended and rearward when the tilt cylinders 19 are retracted.

The hydraulic control apparatus of the second embodiment will hereafter be described with reference to FIG. 3.

The hydraulic control apparatus controls operation of each lift cylinder 14 and operation of each tilt cylinder 19. As illustrated in FIG. 3, in the hydraulic control apparatus according to the second embodiment, a hydraulic circuit for operating the lift cylinder 14 and the tilt cylinder 19 is formed by a single pump and a single motor for driving the pump.

A fluid passage K1 serving as a first fluid passage connected to a bottom chamber 14*b* of the lift cylinder 14 is connected to a hydraulic pump/motor 30 functioning as a hydraulic pump and a hydraulic motor. In the second embodiment, the fluid passage K1 is connected to an outlet port 30*a* of the hydraulic pump/motor 30. A motor (a rotating electrical machine) 31 functioning as an electric motor and an electricity generator is connected to the hydraulic pump/motor 30. In the second embodiment, the motor 31 functions as an electric motor when the hydraulic pump/motor 30 is operated as a hydraulic pump and as an electricity generator when the hydraulic pump/motor 30 is driven as the hydraulic motor. The hydraulic pump/motor 30 of the second embodiment is rotational in opposite directions.

A fork lowering proportional valve 32 is provided in the fluid passage K1, which connects the lift cylinder 14 to the hydraulic pump/motor 30. Specifically, the fork lowering proportional valve 32 is arranged on the side corresponding to the lift cylinder 14. The fork lowering proportional valve 32 is switchable between a first position 32*a* corresponding to a closed state for prohibiting hydraulic fluid flow and a second position 32*b* corresponding to an open state with an adjustable opening degree for permitting flow of the hydraulic fluid delivered from the bottom chamber 14*b*. In the second embodiment, the fork lowering proportional valve 32 blocks the hydraulic fluid flow from the bottom chamber 14*b* to the hydraulic pump/motor 30 when arranged at the first position 32*a*. The fork lowering proportional valve 32 permits the hydraulic fluid flow from the bottom chamber 14*b* to the hydraulic pump/motor 30 when switched to the second position 32*b*. The fork lowering proportional valve 32 thus configures an outflow control mechanism.

An electromagnetic switch valve 33 is provided in the fluid passage K1 and arranged between the hydraulic pump/motor 30 and the fork lowering proportional valve 32. The electromagnetic switch valve 33 is switchable between a first position 33*a* corresponding to a closed state for prohibiting hydraulic fluid flow and a second position 33*b* corresponding to an open state for permitting hydraulic fluid flow from the side corresponding to the fork lowering proportional valve 32. In the second embodiment, the electromagnetic switch valve 33 is configured by an on-off valve switchable between two positions, which are the first position 33*a* and the second position 33*b*. The electromagnetic switch valve 33 functions as an opening/closing mechanism for selectively opening and closing the fluid passage K1. The electromagnetic switch valve 33 sets the fluid passage K1 in the closed state when switched to the first position 33*a* and in the open state when arranged at the second position 33*b*. When the fork 16 is lowered, the opening degree of the fork lowering proportional valve 32 and the opening degree of the electromagnetic switch valve 33 are controlled to adjust the flow rate of the hydraulic fluid flowing to the hydraulic pump/motor 30.

A fluid passage K2 is connected to an inlet port 30*b* of the hydraulic pump/motor 30. When the hydraulic pump/motor 30 operates as a hydraulic pump and draws hydraulic fluid from the fluid tank T, the hydraulic fluid flows through the fluid passage K2. A check valve 34 for permitting flow of hydraulic fluid from the fluid tank T to the hydraulic pump/motor 30 is arranged in the fluid passage K2. A fluid passage K3 is also connected to the inlet port 30*b* of the hydraulic pump/motor 30. When the hydraulic pump/motor 30 operates as a hydraulic motor to draw hydraulic fluid through the outlet port 30*a* and discharge the hydraulic fluid through the inlet port 30*b* (as returned hydraulic fluid), the hydraulic fluid flows through the fluid passage K3 to return to the fluid tank T. A check valve 35 for permitting flow of hydraulic fluid from the hydraulic pump/motor 30 to the fluid tank T is arranged in the fluid passage K3. The returned hydraulic fluid is introduced into the fluid tank T through a filter 36.

Figure 3:
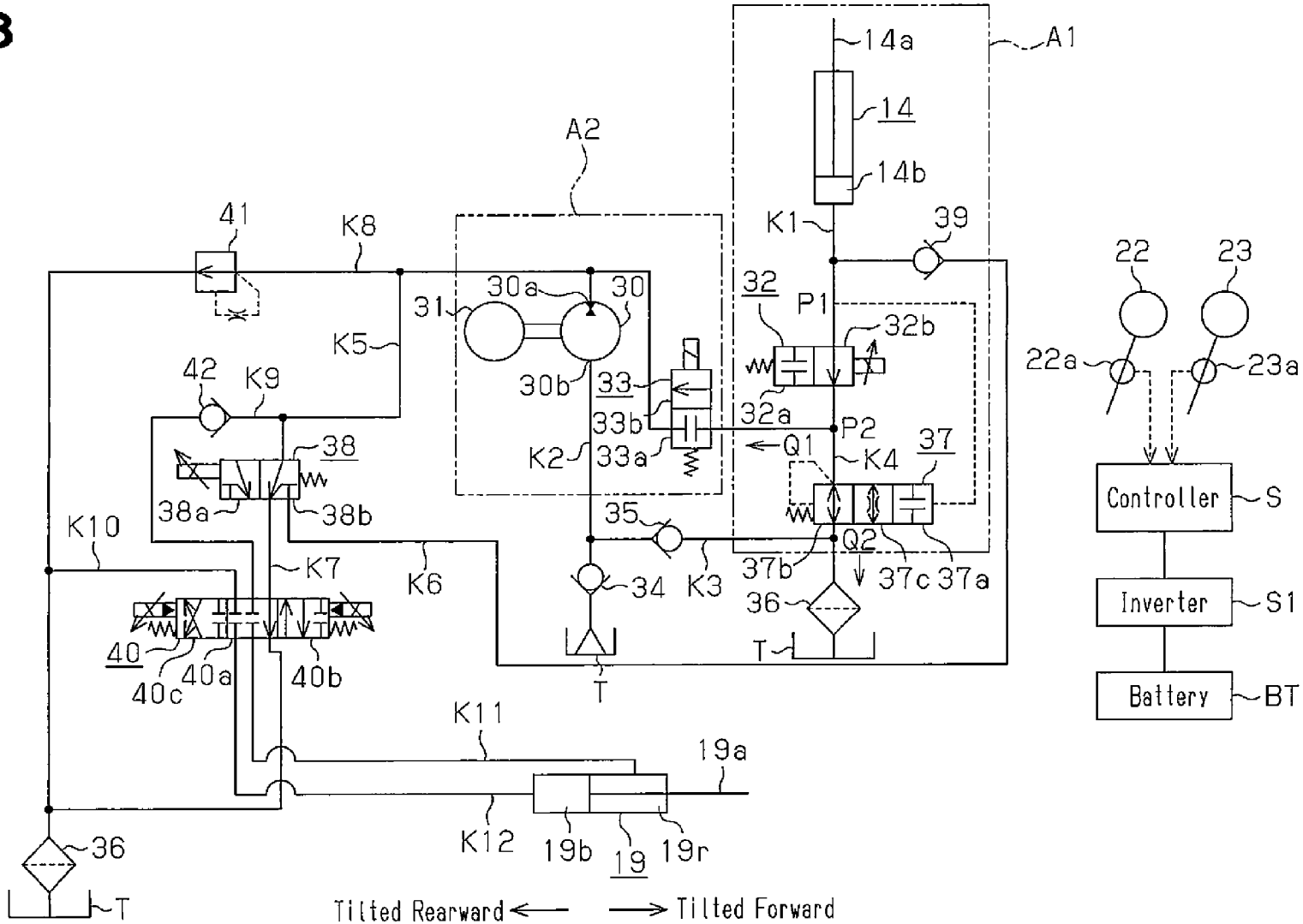
FIG. 3 is a circuit diagram representing a hydraulic control apparatus according to the second embodiment.

As illustrated in FIG. 3, in the second embodiment, the hydraulic fluid delivered from the bottom chamber 14*b* of the lift cylinder 14 flows into the outlet port 30*a* of the hydraulic pump/motor 30 via the fluid passage K1. The fluid passage K2, which is connected to the inlet port 30*b* of the hydraulic pump/motor 30, thus does not receive pressure. As a result, the hydraulic pump/motor 30 does not have to be configured to receive pressure on both the outlet port 30*a* and the inlet port 30*b* but may be configured to receive pressure only on the outlet port 30*a*. In other words, the hydraulic pump/motor 30 may be incapable of receiving pressure on the inlet port 30*b*. Accordingly, the hydraulic pump/motor 30 of the hydraulic control apparatus of the second embodiment is configured to receive pressure only on the outlet port 30*a*.

A bypass fluid passage K4 serving as a second fluid passage branched from the fluid passage K1 and connected to the fluid tank T is connected to the hydraulic fluid outlet side of the fork lowering proportional valve 32. A flow control valve 37 for controlling the flow rate of the hydraulic fluid flowing through the bypass fluid passage K4 is provided in the bypass fluid passage K4. In the second embodiment, the flow control valve 37 is arranged between the fork lowering proportional valve 32 and the fluid tank T. The flow control valve 37 is switchable among a first position 37*a* corresponding to a fully closed state, a second position 37*b* corresponding to a fully open state, and a third position 37*c* corresponding to an open state with an adjustable opening degree. In the second embodiment, the flow control valve 37 operates to switch to any one of the first position 37*a*, the second position 37*b*, and the third position 37*c* in correspondence with the difference between the pressure P1 in the zone between the lift cylinder 14 and the fork lowering proportional valve 32 and the pressure P2 in the zone between the fork lowering proportional valve 32 and the hydraulic pump/motor 30.

Specifically, the flow control valve 37 operates to decrease the opening degree as the difference between the pressure P1 and the pressure P2 increases and increase the opening degree as the difference between the pressure P1 and the pressure P2 decreases. Accordingly, if the flow control valve 37 is switched to the first position 37*a*, the hydraulic fluid delivered from the bottom chamber 14*b* of the lift cylinder 14 flows to the outlet port 30*a* of the hydraulic pump/motor 30 through the fork lowering proportional valve 32 and the electromagnetic switch valve 33 only when the electromagnetic switch valve 33 is arranged at the second position 33*b*. In other words, in this case, the full amount of the hydraulic fluid that has passed through the fork lowering proportional valve 32 and the electromagnetic switch valve 33 flows to the outlet port 30*a* of the hydraulic pump/motor 30 at the flow rate Q1 represented in FIG. 3. In contrast, when the flow control valve 37 is located at the second position 37*b* or the third position 37*c*, the hydraulic fluid delivered from the bottom chamber 14*b* of the lift cylinder 14 flows to the outlet port 30*a* of the hydraulic pump/motor 30 and to the fluid tank T through the fork lowering proportional valve 32 and the electromagnetic switch valve 33 only when the electromagnetic switch valve 33 is arranged at the second position 33*b*. That is, in this case, the hydraulic fluid that has passed through the fork lowering proportional valve 32 flows to the outlet port 30*a* of the hydraulic pump/motor 30 at the flow rate Q1 represented in FIG. 3 and to the fluid tank T at the flow rate Q2 represented in FIG. 3. The flow control valve 37 is adjusted in advance to open by a desired opening degree in correspondence with the aforementioned pressure difference.

A fluid passage K5 is connected to the outlet port 30*a* of the hydraulic pump/motor 30. When the hydraulic pump/motor 30 functions as a hydraulic pump and discharges hydraulic fluid, the hydraulic fluid is delivered to the fluid passage K5. A fork raising proportional valve 38 and a check valve 39 are provided in the fluid passage K5. The fork raising proportional valve 38 is switchable between a first position 38*a* corresponding to an open state with an adjustable opening degree and a second position 38*b* corresponding to a closed state. When arranged at the first position 38*a*, the fork raising proportional valve 38 delivers the hydraulic fluid discharged by the hydraulic pump/motor 30 to the bottom chamber 14*b* via a fluid passage K6. When switched to the second position 38*b*, the fork raising proportional valve 38 delivers the hydraulic fluid discharged by the hydraulic pump/motor 30 to a tilting proportional valve 40 through a fluid passage K7. The check valve 39 permits the hydraulic fluid to flow from the fork raising proportional valve 38 to the bottom chamber 14*b* of the lift cylinder 14 but prohibits flow of hydraulic fluid in the opposite direction.

A fluid passage K8 connected to the fluid tank T through the filter 36 and a fluid passage K9 connected to the tilting proportional valve 40 are branched from the fluid passage K5. A relief valve 41 for preventing hydraulic pressure rise is provided in the fluid passage K8. A fluid passage K10 for delivering hydraulic fluid from the tilting proportional valve 40 to the fluid tank T is branched from the fluid passage K8. A check valve 42 is provided in the fluid passage K9 and permits flow of hydraulic fluid from the fluid passage K5 but prohibits flow of hydraulic fluid in the opposite direction.

The tilting proportional valve 40 is switchable among a first position 40*a* corresponding to a closed state, a second position 40*b* corresponding to an open state with an adjustable opening degree, and a third position 40*c* corresponding to an open state with an adjustable opening degree. When arranged at the first position 40*a*, the tilting proportional valve 40 delivers hydraulic fluid from the fork raising proportional valve 38 to the fluid tank T. In the tilting proportional valve 40 of the second embodiment, the first position 40*a* corresponds to a neutral position. The tilting proportional valve 40 is switched to either the second position 40*b* or the third position 40*c* through control by the controller S. When arranged at the second position 40*b*, the tilting proportional valve 40 delivers hydraulic fluid from the check valve 42 to a fluid passage K11, which is connected to a rod chamber 19*r* of a tilt cylinder 19. When at the second position 40*b*, the tilting proportional valve 40 delivers hydraulic fluid from a fluid passage K12, which is connected to a bottom chamber 19*b* of the tilt cylinder 19, to the fluid passage K10. When at the third position 40*c*, the tilting proportional valve 40 delivers hydraulic fluid from the check valve 42 to the fluid passage K12 and from the fluid passage K11 to the fluid passage K10. In the second embodiment, the fluid passages K5, K9, K11, and K12 configure a third fluid passage.

The configuration of the controller S of the hydraulic control apparatus will hereafter be described.

A potentiometer 22*a* for detecting the manipulation amount of the lift lever 22 and a potentiometer 23*a* for detecting the manipulation amount of the tilt lever 23 are electrically connected to the controller S. The controller S controls rotation of the motor 31 and regulates the opening degrees of the fork lowering proportional valve 32 and the fork raising proportional valve 38 with reference to a detection signal provided by the potentiometer 22*a* in correspondence with the manipulation amount of the lift lever 22. The controller S controls the rotation of the motor 31 and the opening degree of the tilting proportional valve 40 with reference to a detection signal sent from the potentiometer 23*a* in correspondence with the manipulation amount of the tilt lever 23. The controller S also controls the opening degree of the electromagnetic switch valve 33.

An inverter S1 is electrically connected to the controller S. The motor 31 receives electricity from the battery BT through the inverter S1. The electricity generated by the motor 31 is stored in the battery BT through the inverter S1. In the second embodiment, the forklift is driven by the electricity stored in the battery BT as a drive source.

The hydraulic control apparatus of the second embodiment operates in the manner described below.

Independent operations including raising of the fork 16, forward tilting of the mast 13, and rearward tilting of the mast 13 will be described first. Specifically, an independent operation refers to a case in which the fork 16 is operated without tilting the mast 13 forward or rearward or a case in which the mast 13 is tilted forward or rearward without raising or lowering the fork 16.

To raise the fork 16, hydraulic fluid is supplied to the bottom chamber 14*b* of the lift cylinder 14. Accordingly, the controller S calculates the necessary rotation speed of the hydraulic pump/motor 30 and the opening degree of the fork raising proportional valve 38 that are necessary for raising the fork 16 at the instructed speed corresponding to the manipulation amount of the lift lever 22. The controller S then operates the motor 31 at the obtained necessary rotation speed as the instructed rotation speed of the motor 31 and opens the fork raising proportional valve 38 at the first position 38*a* by the calculated opening degree. For fork raising, the controller S arranges the fork lowering proportional valve 32 and the electromagnetic switch valve 33 at the first position 32*a* and the first position 33*a*, respectively.

In this manner, the hydraulic pump/motor 30 functions as a hydraulic pump through rotation of the motor 31, thus drawing hydraulic fluid from the fluid tank T and discharging the hydraulic fluid through the outlet port 30*a*. The hydraulic fluid then flows through the fluid passages K5, K6 and is delivered to the bottom chamber 14*b* through the fork raising proportional valve 38 and the check valve 39. This extends the lift cylinder 14 to raise the fork 16. To end the fork raising, the controller S stops the motor 31 and switches the fork raising proportional valve 38 to the second position 38*b*.

To tilt the mast 13 rearward, hydraulic fluid is supplied to the rod chamber 19*r* of the tilt cylinder 19 and delivered from the bottom chamber 19*b*. Accordingly, the controller S calculates the necessary rotation speed of the hydraulic pump/motor 30 and the opening degree of the tilting proportional valve 40 necessary for tilting the mast 13 rearward at the instructed speed corresponding to the manipulation amount of the tilt lever 23. The controller S then operates the motor 31 at the calculated necessary rotation speed as the instructed rotation speed of the motor 31 and opens the tilting proportional valve 40 at the second position 40*b* by the calculated opening degree. To tilt the mast 13 rearward, the controller S switches the fork lowering proportional valve 32 and the electromagnetic switch valve 33 at the first position 32*a* and the first position 33*a*, respectively, and maintains the fork raising proportional valve 38 at the second position 38*b*.

In this manner, the hydraulic pump/motor 30 functions as a hydraulic pump through rotation of the motor 31, thus drawing hydraulic fluid from the fluid tank T and discharging the hydraulic fluid through the outlet port 30*a*. The hydraulic fluid then flows through the fluid passage K5 and is delivered from the fluid passage K11 to the rod chamber 19*r* through the check valve 42 and the tilting proportional valve 40. Meanwhile, the hydraulic fluid in the bottom chamber 19*b* is delivered to the fluid passage K12 and delivered from the fluid passage K10 to the fluid tank T via the tilting proportional valve 40. This retracts the tilt cylinder 19 to tilt the mast 13 rearward. To end rearward mast tilting, the controller S stops the motor 31 and switches the tilting proportional valve 40 to the first position 40*a*.

In contrast, to tilt the mast 13 forward, hydraulic fluid is supplied to the bottom chamber 19*b* of the tilt cylinder 19 and delivered from the rod chamber 19*r*. Accordingly, the controller S calculates the necessary rotation speed of the hydraulic pump/motor 30 and the opening degree of the tilting proportional valve 40 necessary for tilting the mast 13 forward at the instructed speed corresponding to the manipulation amount of the tilt lever 23. The controller S then operates the motor 31 at the calculated necessary rotation speed as the instructed rotation speed of the motor 31 and opens the tilting proportional valve 40 at the third position 40*c* by the calculated opening degree. To tilt the mast 13 forward, the controller S switches the fork lowering proportional valve 32 and the electromagnetic switch valve 33 at the first position 32*a* and the first position 33*a*, respectively, and arranges the fork raising proportional valve 38 at the second position 38*b*.

In this manner, the hydraulic pump/motor 30 functions as a hydraulic pump through rotation of the motor 31, thus drawing hydraulic fluid from the fluid tank T and discharging the hydraulic fluid through the outlet port 30*a*. The hydraulic fluid then flows through the fluid passage K5 and is delivered from the fluid passage K12 to the bottom chamber 19*b* through the check valve 42 and the tilting proportional valve 40. Meanwhile, the hydraulic fluid in the rod chamber 19*r* is delivered to the fluid passage K11 and delivered from the fluid passage K10 to the fluid tank T via the tilting proportional valve 40. This extends the tilt cylinder 19 to tilt the mast 13 forward. To end forward tilting of the mast 13, the controller S stops the motor 31 and switches the tilting proportional valve 40 to the first position 40*a*.

An independent operation for lowering the fork 16 and a simultaneous operation for lowering the fork 16 and tilting the mast 13 forward or rearward will hereafter be described. The simultaneous operation refers to simultaneous operating of the fork 16 and the mast 13.

Lowering of the fork 16 will be described first.

If lowering of the fork 16 is instructed through manipulation of the lift lever 22 but the tilt lever 23 is not being manipulated, the controller S performs control for lowering the fork 16 as an independent operation. In the control, the controller S calculates the necessary rotation speed of the hydraulic pump/motor 30 and the opening degree of the fork lowering proportional valve 32 necessary for lowering the fork 16 at the instructed speed corresponding to the manipulation amount of the lift lever 22. The controller S then operates the motor 31 at the calculated necessary rotation speed as the instructed rotation speed of the motor 31 and opens the fork lowering proportional valve 32 at the second position 32*b* by the calculated opening degree. The controller S then switches the electromagnetic switch valve 33 to the second position 33*b*. The controller S also arranges the fork raising proportional valve 38 at the second position 38*b* and the tilting proportional valve 40 at the first position 40*a*.

When the fork lowering proportional valve 32 is open, the hydraulic fluid delivered from the bottom chamber 14*b* of the lift cylinder 14 flows through the fluid passage K1 and is delivered to the outlet port 30*a* of the hydraulic pump/motor 30 via the fork lowering proportional valve 32 and the electromagnetic switch valve 33. At this stage, if the hydraulic pump/motor 30 operates at the instructed rotation speed while being driven by the hydraulic fluid delivered from the bottom chamber 14*b* as drive force, the motor 31 outputs negative output and performs regenerative operation. In other words, the motor 31 functions as an electricity generator as the hydraulic pump/motor 30 functions as a hydraulic motor. As a result, the electricity generated by the motor 31 functioning as an electricity generator is stored in the battery BT through the inverter S1. To end lowering of the fork 16, the controller S stops the motor 31 and arranges the fork lowering proportional valve 32 and the electromagnetic switch valve 33 at the first position 32*a* and the first position 33*a*, respectively.

Such regenerative operation may be carried out when the fork 16 is lowered carrying a sufficiently heavy load. That is, in this case of fork lowering, the weight of the fork 16 and the weight of the load facilitate delivery of hydraulic fluid from the bottom chamber 14*b*. This delivers the hydraulic fluid to the outlet port 30*a* of the hydraulic pump/motor 30 in correspondence with the opening degree of the fork lowering proportional valve 32 at the flow rate necessary for lowering the fork 16 at the instructed speed corresponding to the manipulation amount of the lift lever 22. As a result, the hydraulic pump/motor 30 operates at the necessary rotation speed for fork lowering at the instructed speed corresponding to the manipulation amount of the lift lever 22, which is the instructed rotation speed, without performing powering operation of the motor 31. When the regenerative operation is performed, the fork lowering speed is controlled in correspondence with the opening degree of the fork lowering proportional valve 32.

The flow control valve 37 is switchable between a closed state and an open state with a desired opening degree in correspondence with the difference between the pressure P1 and the pressure P2. In the second embodiment, when the fork lowering proportional valve 32 is arranged at the first position 32*a* and fork lowering is not being performed, the flow control valve 37 is set in a closed state (at the first position 37*a*) in correspondence with the difference between pressure P1 and pressure P2 (P1>P2). When the fork lowering proportional valve 32 is set in an open state (at the second position 32*b*) and starts to deliver the hydraulic fluid, the difference between the pressure P1 and the pressure P2 decreases to switch the flow control valve 37 to the open state. At this stage, the hydraulic fluid flows to the hydraulic pump/motor 30 via the fluid passage K1 (at the flow rate Q1 represented in FIG. 3) and to the fluid tank T (the drain side) through the fluid passage K4 at the flow rate corresponding to the opening degree of the flow control valve 37 (at the flow rate Q2 represented in FIG. 3). Then, as the rotation speed of the hydraulic pump/motor 30 increases and the difference between the pressure P1 and the pressure P2 increases, the flow control valve 37 is returned to the closed state. At this stage, the hydraulic fluid flows only to the hydraulic pump/motor 30 via the fluid passage K1 (at the flow rate Q1 represented in FIG. 3).

If, unlike when the regenerative operation is carried out, it is impossible to control the speed for lowering the fork 16 to become equal to the instructed speed through adjustment of the opening degree of the fork lowering proportional valve 32, the flow control valve 37 is opened by a desired opening degree to achieve the instructed speed.

When the fork 16 is lowered carrying a light load, the weight of the fork 16 and the weight of the load cannot facilitate delivery of hydraulic fluid from the bottom chamber 14*b*. It is thus unlikely that the outlet port 30*a* of the hydraulic pump/motor 30 receives hydraulic fluid at the flow rate necessary for lowering the fork 16 at the instructed speed corresponding to the manipulation amount of the lift lever 22. Accordingly, to drive the hydraulic pump/motor 30 at the instructed rotation speed and achieve the instructed speed, powering operation of the motor 31 must be carried out. However, such powering operation of the motor 31 consumes electricity. To solve this problem, the controller S of the second embodiment restricts the rotation speed of the motor 31. Specifically, the controller S drives the motor 31 at the upper limit rotation speed that allows operation of the motor 31 as an electricity generator. By restricting the rotation speed of the motor 31 in this manner, the rotation speed of the motor 31 is decreased such that the flow rate becomes short of the value necessary for fork lowering at the instructed speed. However, the flow control valve 37 operates to compensate for the shortage in the flow rate.

Specifically, as the flow rate of the hydraulic fluid flowing to the hydraulic pump/motor 30 decreases, the pressure P2 rises to decrease the difference between the pressure P1 and the pressure P2, thus opening the flow control valve 37. In this manner, the hydraulic fluid delivered from the lift cylinder 14 flows to the hydraulic pump/motor 30 (at the flow rate Q1 represented in FIG. 3) and to the fluid tank T (the drain side) through the flow control valve 37 (at the flow rate Q2 represented in FIG. 3). In other words, by opening the fluid passage K4, which is a hydraulic fluid passage, by the flow control valve 37, the aforementioned shortage in the flow rate is compensated for so that the instructed fork lowering speed is achieved. As has been described, if the regenerative operation cannot be performed when the fork 16 is lowered, the hydraulic control apparatus of the second embodiment saves electricity consumption and achieves the instructed fork lowering speed through control of the motor 31 and operation of the flow control valve 37.

A simultaneous operation for lowering the fork 16 and tilting the mast 13 forward or rearward will hereafter be described.

In this case, the controller S calculates the necessary rotation speed of the hydraulic pump/motor 30 and the opening degree of the fork lowering proportional valve 32 necessary for fork lowering at the instructed speed corresponding to the manipulation amount of the lift lever 22. The controller S also calculates the necessary rotation speed of the hydraulic pump/motor 30 and the opening degree of the tilting proportional valve 40 necessary for forward or rearward mast tilting at the instructed speed corresponding to the manipulation amount of the tilt lever 23.

In the second embodiment, to perform a simultaneous operation for raising or lowering the fork 16 and tilting the mast 13 forward or rearward, the hydraulic control apparatus uses the necessary rotation speed of the motor 31 necessary for tilting the mast 13 forward or rearward as the instructed rotation speed of the motor 31. The controller S thus sets the necessary rotation speed necessary for tilting the mast 13 forward or rearward to the instructed rotation speed of the motor 31. The controller S then opens the fork lowering proportional valve 32 at the second position 32*b* by the calculated opening degree and opens the tilting proportional valve 40 at the second position 40*b* or the third position 40*c* by the calculated opening degree. Specifically, the controller S opens the tilting proportional valve 40 at the second position 40*b* to tilt the mast 13 rearward and at the third position 40*c* to tilt the mast 13 forward. The controller S also arranges the fork raising proportional valve 38 at the second position 38*b*.

The controller S switches the electromagnetic switch valve 33 to the first position 33*a*. This closes the fluid passage K1, which delivers hydraulic fluid from the bottom chamber 14*b* of the lift cylinder 14 to the outlet port 30*a* of the hydraulic pump/motor 30. In other words, the hydraulic fluid delivered from the bottom chamber 14*b* is not delivered to the hydraulic pump/motor 30. Accordingly, in the second embodiment, the hydraulic control apparatus operates the flow control valve 37 to deliver the hydraulic fluid from the bottom chamber 14*b* to the fluid tank T. In other words, when the electromagnetic switch valve 33 is at the first position 33*a*, the hydraulic fluid is not delivered to the hydraulic pump/motor 30. This increases the pressure P2, thus decreasing the difference between the pressure P1 and the pressure P2 such that the flow control valve 37 is switched to the open state. In this manner, the hydraulic fluid delivered from the bottom chamber 14*b* is delivered to the fluid tank T (the drain side) via the flow control valve 37 (at the flow rate Q2 represented in FIG. 3). As a result, by opening the fluid passage K4, which is a hydraulic fluid passage, by means of the flow control valve 37, the hydraulic fluid delivered from the bottom chamber 14*b* is allowed to flow through the fluid passage K4 such that the instructed fork lowering speed is achieved.

The mast 13 is tilted forward or rearward in the same manner as when the mast 13 is tilted forward or rearward in the independent operation. Specifically, as the motor 31 is rotated, the hydraulic pump/motor 30 functions as a hydraulic pump to draw hydraulic fluid from the fluid tank T and discharges the hydraulic fluid through the outlet port 30*a*. The hydraulic fluid is then delivered to the fluid passage K5 flows through the check valve 42 and the tilting proportional valve 40, and reaches the rod chamber 19*r* through the fluid passage K11 or the bottom chamber 19*b* via the fluid passage K12. This tilts the mast 13 forward or rearward at the instructed speed corresponding to the manipulation amount of the tilt lever 23.

As a result, when the fork 16 is lowered and the mast 13 is tilted forward or rearward as the simultaneous operation using the single hydraulic pump/motor 30 and the single motor 31, the hydraulic control apparatus of the second embodiment achieves both the instructed speed for lowering the fork 16 and the instructed speed for tilting the mast 13 forward or rearward. Specifically, to lower the fork 16, the electromagnetic switch valve 33 is switched to the first position 33*a* to prohibit hydraulic fluid flow to the hydraulic pump/motor 30. Also, the flow control valve 37 is operated to deliver hydraulic fluid to the fluid tank T at the flow rate necessary for achieving the instructed speed corresponding to the manipulation amount of the lift lever 22. The fork 16 is lowered without being influenced by the rotation speed of the hydraulic pump/motor 30 controlled to achieve the instructed speed corresponding to the manipulation amount of the tilt lever 23. Meanwhile, by prohibiting the hydraulic fluid flow to the hydraulic pump/motor 30, the mast 13 is tilted forward or rearward without being influenced at the flow rate of the hydraulic fluid delivered from the lift cylinder 14.

Even when the independent operation for lowering the fork 16 is switched to the simultaneous operation in which the mast 13 is tilted forward or rearward, the instructed speeds for both fork lowering and mast tilting are achieved by carrying out the above-described control. When the simultaneous operation is switched back to the independent operation of the fork 16, regenerative operation of the motor 31 is ensured by performing the control for the independent operation, as in the above-described case.

The second embodiment has the advantages described below.

(6) Since the hydraulic fluid delivered from the lift cylinder 14 is delivered to the outlet port 30*a* of the hydraulic pump/motor 30, the fluid passage K2 (the zone extending between the hydraulic pump/motor 30 and the tank T) does not have to be configured to receive pressure. As a result, the hydraulic pump/motor 30 only needs to be configured to receive pressure on the outlet port 30*a* of the hydraulic pump/motor 30. This simplifies the configuration of the hydraulic pump/motor 30. As a result, the configuration of the hydraulic control apparatus is also simplified.

(7) If the flow rate of the hydraulic fluid flowing to the hydraulic pump/motor 30 is insufficient for achieving the instructed speed for lowering the fork 16, the fork 16 is lowered at the instructed speed by controlling the flow rate in the fluid passage K1 and the flow rate in the fluid passage K4 by means of the flow control valve 37. This makes it unnecessary to consume electricity for operation of the hydraulic pump/motor 30 to lower the fork 16 at the instructed speed, thus ensuring effects of regenerative operation. In other words, the electricity obtained through the regenerative operation is effectively consumed without being used to lower the fork 16.

(8) The lift cylinder 14 and the tilt cylinder 19 receive hydraulic fluid from the hydraulic pump/motor 30. However, the hydraulic fluid delivered from the lift cylinder 14 drives the hydraulic pump/motor 30 to carry out regenerative operation in the independent operation of lowering the fork 16. That is, despite the configuration in which the multiple hydraulic cylinders are connected to the single hydraulic pump/motor 30, the hydraulic pump/motor 30 is allowed to perform the regenerative operation.

(9) In the simultaneous operation, the mast 13 is tilted forward or rearward at the instructed speed corresponding to the manipulation amount of the tilt lever 23 by closing the fluid passage K1 by means of the electromagnetic switch valve 33. Also, the fork 16 is lowered at the instructed speed corresponding to the manipulation amount of the lift lever 22 by controlling the flow rate in the fluid passage K1 and the flow rate in the fluid passage K4 by means of the flow control valve 37. In other words, the fork 16 and the mast 13 are operated at the respective instructed speeds in the simultaneous operation.

(10) Since the flow rate in the fluid passage K4 is continuously varied by means of the flow control valve 37, chattering and impact are unlikely to happen when the flow rate is changed.

(11) The flow control valve 37 is arranged in parallel with the passage between the lift cylinder 14 and the hydraulic pump/motor 30. This decreases pressure loss, thus ensuring highly efficient regenerative operation.

(12) The electromagnetic switch valve 33, which is an on-off valve, is employed as the opening/closing mechanism for selectively opening and closing the fluid passage K1. This simplifies the control.

(13) The flow control valve 37 is selectively opened and closed in correspondence with the pressure difference. This simplifies the configuration and control of the hydraulic control apparatus compared with a case in which the opening degree of the flow control valve 37 is electrically regulated.

(14) Although the hydraulic control apparatus is configured by the single hydraulic pump/motor 30 and the single motor 31, the instructed speeds for the respective operations are achieved using the flow control valve 37. The cost for the hydraulic control apparatus as a whole is thus decreased compared with a case in which multiple hydraulic pump/motors and multiple motors configure a hydraulic control apparatus. Also, the space for installing the hydraulic control apparatus is saved to maintain the size of the vehicle without enlarging.

Each of the embodiments may be modified as follows.

In the first embodiment, the raising/lowering proportional valve 2 may be replaced by a lowering proportional valve, which is arranged between the flow control valve 6 and the fluid tank Ta at a position closer to the fluid tank Ta than the check valve 4. In this case, an outflow control mechanism (a lift lock mechanism) for stopping hydraulic fluid from flowing out of the bottom chamber 1*b* of the lift cylinder 1 is provided between the lift cylinder 1 and the flow control valve 6 at a position closer to the lift cylinder 1 than the hydraulic pump/motor PM.

Figure 4:
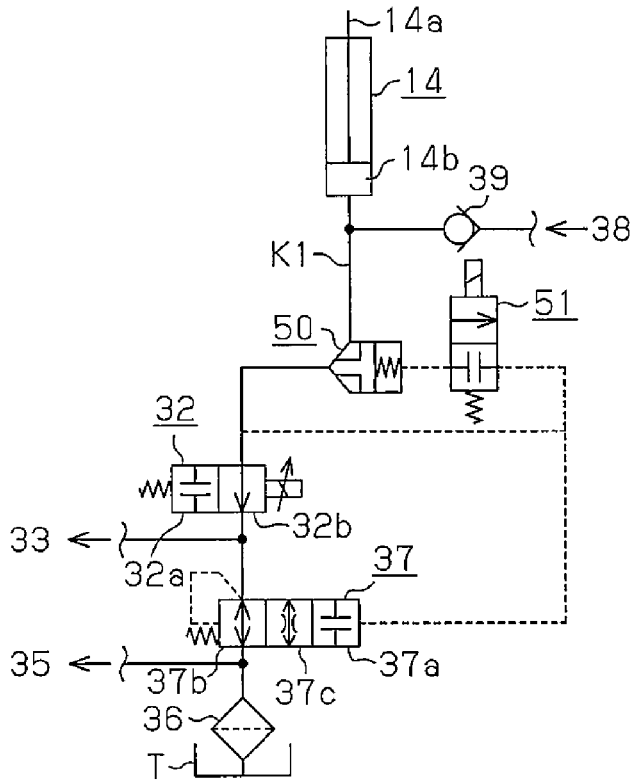
FIG. 4 is a circuit diagram representing a portion of a hydraulic control apparatus of a modification.

The circuit configuration of the second embodiment may be modified as illustrated in FIG. 4. FIG. 4 corresponds to a region A1 indicated by a broken line in which a long dash alternates with a pair of short dashes in FIG. 3. The outflow control mechanism represented in FIG. 4 is configured by a poppet valve 50 and an electromagnetic valve 51, in addition to the fork lowering proportional valve 32. To lower the fork 16, the poppet valve 50 and the electromagnetic valve 51 are opened and the flow rate of the hydraulic fluid delivered to the hydraulic pump/motor 30 is controlled through adjustment of the opening degree of the fork lowering proportional valve 32. The flow control valve 37 is opened using the difference between the pressure in the zone between the lift cylinder 14 and the fork lowering proportional valve 32 and the pressure in the zone between the fork lowering proportional valve 32 and the hydraulic pump/motor 30.

Figure 5:
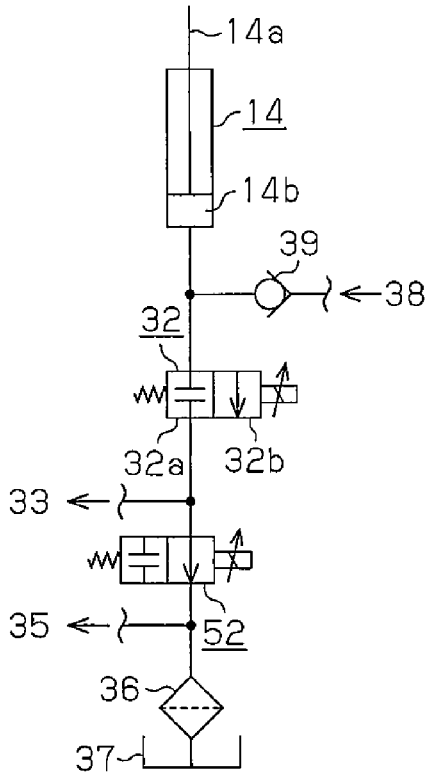
FIG. 5 is a circuit diagram representing a portion of a hydraulic control apparatus of another modification.

The circuit configuration of the second embodiment may be modified as illustrated in FIG. 5. FIG. 5 corresponds to a region A2 indicated by a broken line in which a long dash alternates with a pair of short dashes in FIG. 3. As illustrated in FIG. 5, an electromagnetic proportional valve 52 serving as a flow control valve is provided between the hydraulic pump/motor 30 and the fork lowering proportional valve 32. In this case, if the actual rotation speed of the motor 31 is short of the necessary rotation speed of the motor 31 necessary for lowering the fork 16, the controller S opens the electromagnetic proportional valve 52 by the opening degree corresponding to the flow rate that corresponds to the difference in rotation speed. This achieves the instructed speed for lowering the fork 6 as in the second embodiment.

Figure 6:
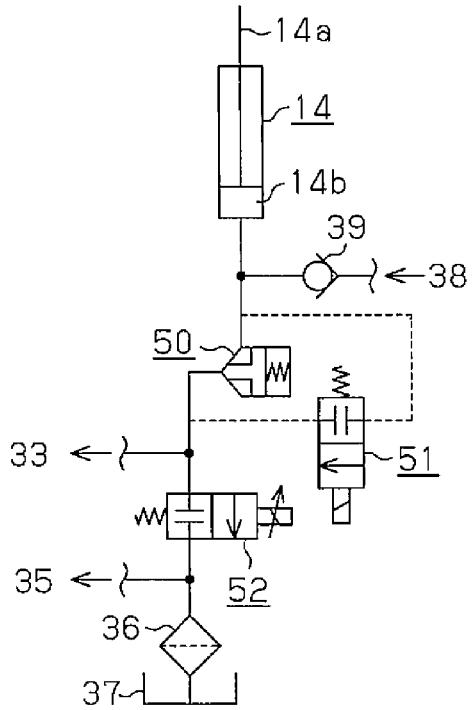
FIG. 6 is a circuit diagram representing a portion of a hydraulic control apparatus of another modification.

The configuration of the flow control valve 37 of the second embodiment may be modified as illustrated in FIG. 6. FIG. 6 corresponds to the region A2 indicated by a broken line in which a long dash alternates with a pair of short dashes in FIG. 3. With reference to FIG. 6, an outflow control mechanism may be configured by a poppet valve 50 and an electromagnetic valve 51. An electromagnetic proportional valve 52 serving as a flow control valve is arranged between the outflow control mechanism and the hydraulic pump/motor 30. To lower the fork 16, the poppet valve 50 and the electromagnetic valve 51 are opened and the flow rate of the hydraulic fluid flowing to the hydraulic pump/motor 30 is controlled through adjustment of the opening degree of the poppet valve 50. If the actual rotation speed of the motor 31 is short of the necessary rotation speed of the motor 31 necessary for lowering the fork 16, the controller S opens the electromagnetic proportional valve 52 by the opening degree corresponding to the flow rate that corresponds to the difference in rotation speed. This achieves the instructed speed for lowering the fork 6 as in the second embodiment.

Figure 7:
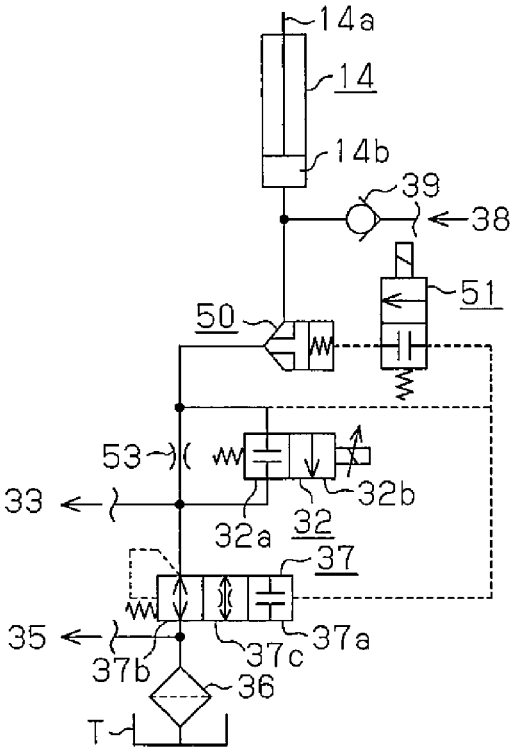
FIG. 7 is a circuit diagram representing a portion of a hydraulic control apparatus of another modification.

The circuit configuration of the second embodiment may be modified as illustrated in FIG. 7. FIG. 7 corresponds to the region A2 indicated by a broken line in which a long dash alternates with a pair of short dashes in FIG. 3. The outflow control mechanism represented in FIG. 7 is configured by a poppet valve 50, an electromagnetic valve 51, and an orifice 53, in addition to the fork lowering proportional valve 32. To lower the fork 16, the poppet valve 50 and the electromagnetic valve 51 are opened and the flow rate of the hydraulic fluid delivered to the hydraulic pump/motor 30 is controlled through adjustment of the opening degree of the fork lowering proportional valve 32. The flow control valve 37 is opened using the difference between the pressure in the zone between the lift cylinder 14 and the fork lowering proportional valve 32 and the pressure in the zone between the fork lowering proportional valve 32 and the hydraulic pump/motor 30.

Figure 8:
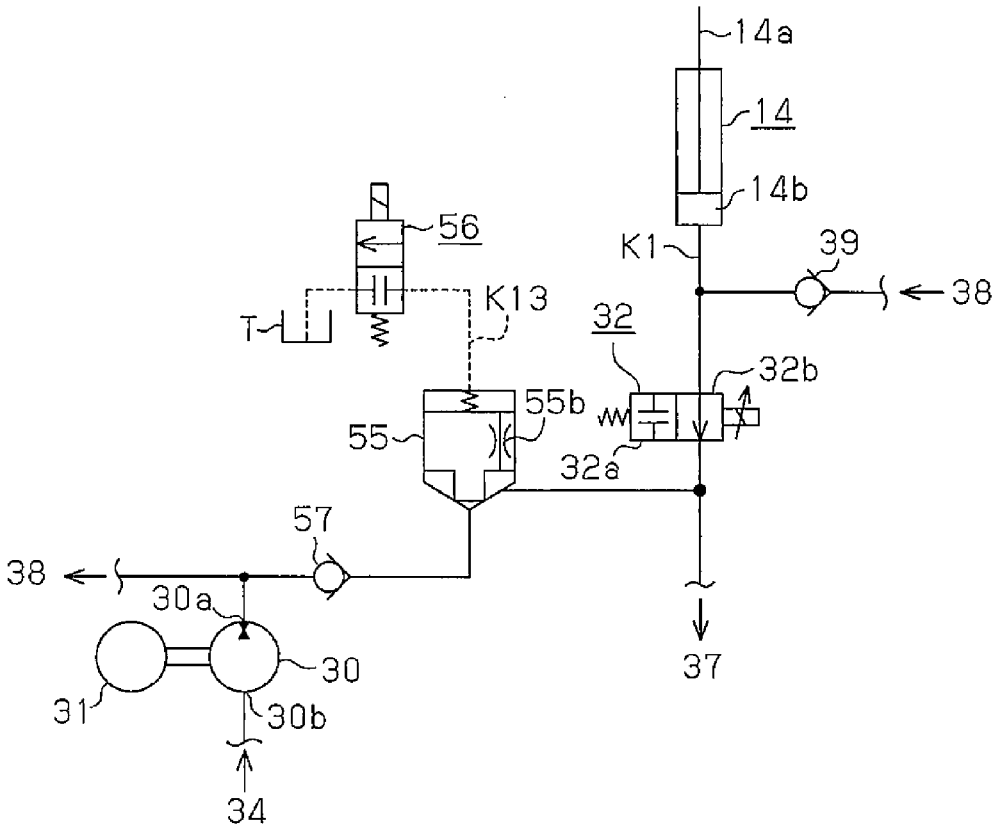
FIG. 8 is a circuit diagram representing a portion of a hydraulic control apparatus of another modification.
Figure 9:
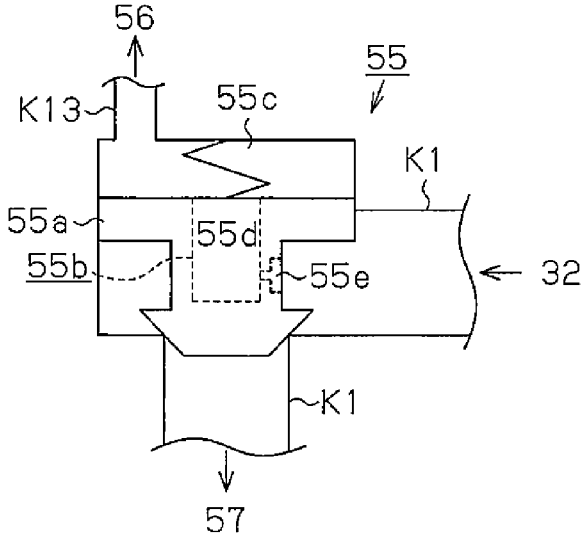
FIG. 9 is a diagram schematically illustrating the interior of a pilot check valve.

The circuit configuration of the second embodiment may be modified as illustrated in FIG. 8. FIG. 8 corresponds to the region A1 and the region A2 each indicated by a line in which a long dash alternates with a pair of short dashes in FIG. 3. Referring to FIG. 8, an opening/closing mechanism for selectively opening and closing the fluid passage K1 may be configured by a pilot check valve 55 and an electromagnetic switch valve 56 instead of the electromagnetic switch valve 33. As schematically shown in FIG. 9, the pilot check valve 55 includes a restriction passage 55*b*, which is located in a valve body 55*a* in the body of the pilot check valve 55. The restriction passage 55*b* connects the fluid passage K1 to a spring chamber 55*c* in the body of the pilot check valve 55. The restriction passage 55*b* is configured by a large-diameter portion 55*d* having an opening facing the spring chamber 55*c* and a small-diameter portion 55*e*, which has a smaller diameter than the large-diameter portion 55*d*. The small-diameter portion 55*e* extends through the body of the pilot check valve 55 from a peripheral surface of the valve body 55*a* to the large-diameter portion 55*d*.

When the difference between the pressure in the fluid passage K1 on the side corresponding to the lift cylinder 14 with respect to the pilot check valve 55 and the pressure on the side corresponding to the spring chamber 55*c* reaches a predetermined value, the pressure difference acts on the valve body 55*a* of the pilot check valve 55 such that the valve body 55*a* is displaced to open the pilot check valve 55. When the pilot check valve 55 is open, the pilot check valve 55 delivers hydraulic fluid delivered from the bottom chamber 14*b* of the lift cylinder 14 to the hydraulic pump/motor 30. In other words, the pilot check valve 55 is set in an open state using the aforementioned pressure difference as pressure for operating the valve body 55*a* (pilot pressure). A fluid passage K13 is connected to the spring chamber 55*c* of the pilot check valve 55. The electromagnetic switch valve 56 functioning as an on-off valve is provided in the fluid passage K13. The force produced by the pressure in the fluid passage K13 acts in the direction in which the valve body 55*a* of the pilot check valve 55 is closed. A fluid tank T is connected to the outlet side of the electromagnetic switch valve 56. To lower the fork 16, the controller S opens the fork lowering proportional valve 32 and the electromagnetic switch valve 56. As a result, as has been described, the pilot check valve 55 opens when the difference between the pressure in the fluid passage K1 on the side corresponding to the lift cylinder 14 and the pressure on the side corresponding to the spring chamber 55*c* reaches the predetermined value. When the pilot check valve 55 is open, hydraulic fluid flows to the outlet port 30*a* of the hydraulic pump/motor 30. A check valve 57 is provided in the section of the fluid passage K1 between the hydraulic pump/motor 30 and the pilot check valve 55 to stop backflow of hydraulic fluid from the hydraulic pump/motor 30 to the pilot check valve 55. By employing the check valve 57, the hydraulic fluid discharged from the hydraulic pump/motor 30 to tilt the mast 13 forward or rearward is prevented from flowing to the lift cylinder 14.

In the modification illustrated in FIG. 8, the outlet side of the electromagnetic switch valve 56 is connected to the fluid tank T. However, a fluid passage may be configured to return hydraulic fluid to the outlet port 30*a* of the hydraulic pump/motor 30.

In the second embodiment, the fork lowering proportional valve 32 and the flow control valve 37 may be replaced by a pressure compensating proportional valve, which is provided in the fluid passage K4 and functions as a fork lowering proportional valve 32 and a flow control valve 37. The pressure compensating proportional valve adjusts the hydraulic fluid flow rate when the pressure of the hydraulic fluid flowing in the pressure compensating proportional valve exceeds a set pressure.

In the second embodiment, the fork lowering proportional valve 32 may be arranged between the flow control valve 37 and the fluid tank T at a position closer to the fluid tank T than the check valve 35. In this case, the outflow control mechanism (the lift lock mechanism) for preventing outflow of hydraulic fluid from the bottom chamber 14*b* of the lift cylinder 14 is arranged between the lift cylinder 1 and the flow control valve 37 at a position closer to the lift cylinder 14 than the electromagnetic switch valve 33.

In the second embodiment, a hydraulic cylinder connected to the hydraulic pump/motor 30 may carry out loading operation other than raising/lowering of the fork 16 or forward/rearward tilting of the mast 13. For example, the hydraulic cylinder may sway the fork 16 sideways or tilt or pivot the fork 16 (as a loading hydraulic cylinder). Alternatively, the hydraulic cylinder may operate a clamp device for clamping a load (as a loading hydraulic cylinder). Specifically, a loading member refers to any component operated through manipulation by the forklift operator to selectively load and unload an object.

DESCRIPTION OF THE REFERENCE NUMERALS 1, 14 . . . lift cylinder, 2 . . . raising/lowering proportional valve, 6, 37 . . . flow control valve, 13 . . . mast, 16, F . . . fork, 19 . . . tilt cylinder, 22 . . . lift lever, 23 . . . tilt lever, 30, PM . . . hydraulic pump/motor, 30*a*, Pa . . . outlet port, 32 . . . fork lowering proportional valve, 31, M . . . motor, 33 . . . electromagnetic switch valve, K1 to K12, Ka to Kd . . . fluid passage, L . . . manipulation lever, S . . . controller, T, Ta . . . fluid tank, Q1, Q2 . . . flow rate.

The invention claimed is:

1. A hydraulic control apparatus for a forklift having a hydraulic lift cylinder that receives or discharges hydraulic fluid through manipulation of a raising/lowering manipulation member to selectively raise and lower a fork, the apparatus comprising:

a hydraulic pump/motor;

a first fluid passage for delivering hydraulic fluid delivered from the hydraulic lift cylinder to an outlet port of the hydraulic pump/motor when the fork is lowered;

an outflow control mechanism provided in the first fluid passage to permit flow of hydraulic fluid from the hydraulic lift cylinder to the hydraulic pump/motor at the time when the fork is lowered but prohibit the flow of hydraulic fluid from the hydraulic lift cylinder to the hydraulic pump/motor at the time when the fork is stopped or raised;

a second fluid passage branched from a section of the first fluid passage between the hydraulic pump/motor and the outflow control mechanism, wherein the second fluid passage delivers hydraulic fluid delivered from the hydraulic lift cylinder to a drain side; and a flow control valve provided in the second fluid passage, wherein the flow control valve controls the flow rate of the hydraulic fluid delivered from the hydraulic lift cylinder to the hydraulic pump/motor and the flow rate of the hydraulic fluid delivered from the hydraulic lift cylinder to the drain side, wherein, if an actual rotation speed of the hydraulic pump/motor is short of a necessary rotation speed necessary for lowering the fork at an instructed speed corresponding to a manipulation amount of the raising/lowering manipulation member, the flow control valve delivers hydraulic fluid to the drain side at a flow rate corresponding to the shortage in the rotation speed.

2. A hydraulic control apparatus for a forklift having a hydraulic lift cylinder that receives or discharges hydraulic fluid through manipulation of a raising/lowering manipulation member to selectively raise and lower a fork, the apparatus comprising:

a hydraulic pump/motor;

a first fluid passage for delivering hydraulic fluid delivered from the hydraulic lift cylinder to an outlet port of the hydraulic pump/motor when the fork is lowered;

an outflow control mechanism provided in the first fluid passage to permit flow of hydraulic fluid from the hydraulic lift cylinder to the hydraulic pump/motor at the time when the fork is lowered but prohibit the flow of hydraulic fluid from the hydraulic lift cylinder to the hydraulic pump/motor at the time when the fork is stopped or raised;

a second fluid passage branched from a section of the first fluid passage between the hydraulic pump/motor and the outflow control mechanism, wherein the second fluid passage delivers hydraulic fluid delivered from the hydraulic lift cylinder to a drain side;

a flow control valve provided in the second fluid passage, wherein the flow control valve controls the flow rate of the hydraulic fluid delivered from the hydraulic lift cylinder to the hydraulic pump/motor and the flow rate of the hydraulic fluid delivered from the hydraulic lift cylinder to the drain side;

a tilting hydraulic cylinder that receives or discharges hydraulic fluid through manipulation of a tilting manipulation member to tilt a mast to which the fork is attached forward or rearward;

a third fluid passage connected to the outlet port of the hydraulic pump/motor, wherein the third fluid passage delivers the hydraulic fluid discharged from the hydraulic pump/motor to the tilting hydraulic cylinder;

an opening/closing mechanism provided in a section of the first fluid passage between the hydraulic pump/motor and the outflow control mechanism, wherein the opening/closing mechanism switches the first fluid passage between an open state for allowing hydraulic fluid to flow through the first fluid passage and a closed state for prohibiting hydraulic fluid from flowing through the first fluid passage; and a controller for controlling a rotating electrical machine for driving the hydraulic pump/motor and controlling the opening/closing mechanism, wherein, when the fork is lowered through an independent operation, the controller controls the opening/closing mechanism to switch to the open state such that the hydraulic fluid delivered from the hydraulic lift cylinder drives the hydraulic pump/motor as a hydraulic motor to cause the rotating electrical machine to perform regenerative operation.

3. The hydraulic control apparatus for a forklift according to claim 2, wherein when a simultaneous operation is performed in which the fork is lowered and the mast is tilted forward or rearward, the controller drives the rotating electrical machine based on a necessary rotation speed of the hydraulic pump/motor necessary for tilting at an instructed speed corresponding to a manipulation amount of the tilting manipulation member and controls the opening/closing mechanism to switch to the closed state, and the opening/closing mechanism in the closed state causes the flow control valve to deliver the hydraulic fluid delivered from the hydraulic lift cylinder to the drain side.

4. A hydraulic control apparatus for a forklift having a hydraulic lift cylinder that receives or discharges hydraulic fluid through manipulation of a raising/lowering manipulation member to selectively raise and lower a fork, the apparatus comprising:

a hydraulic pump/motor;

a first fluid passage for delivering hydraulic fluid delivered from the hydraulic lift cylinder to an outlet port of the hydraulic pump/motor when the fork is lowered;

an outflow control mechanism provided in the first fluid passage to permit flow of hydraulic fluid from the hydraulic lift cylinder to the hydraulic pump/motor at the time when the fork is lowered but prohibit the flow of hydraulic fluid from the hydraulic lift cylinder to the hydraulic pump/motor at the time when the fork is stopped or raised;

a second fluid passage branched from a section of the first fluid passage between the hydraulic pump/motor and the outflow control mechanism, wherein the second fluid passage delivers hydraulic fluid delivered from the hydraulic lift cylinder to a drain side; and a flow control valve provided in the second fluid passage, wherein the flow control valve controls the flow rate of the hydraulic fluid delivered from the hydraulic lift cylinder to the hydraulic pump/motor and the flow rate of the hydraulic fluid delivered from the hydraulic lift cylinder to the drain side;

the flow control valve adjusts the opening degree thereof by difference between a pressure in a zone between the hydraulic lift cylinder and the outflow control mechanism and a pressure in a zone between the outflow control mechanism and the hydraulic pump/motor, thereby controlling the flow rate of the hydraulic fluid flowing to the drain side.

5. A hydraulic control apparatus for a forklift having a hydraulic lift cylinder that receives or discharges hydraulic fluid through manipulation of a raising/lowering manipulation member to selectively raise and lower a fork, the apparatus comprising:

a hydraulic pump/motor;

a first fluid passage for delivering hydraulic fluid delivered from the hydraulic lift cylinder to an outlet port of the hydraulic pump/motor when the fork is lowered;

an outflow control mechanism provided in the first fluid passage to permit flow of hydraulic fluid from the hydraulic lift cylinder to the hydraulic pump/motor at the time when the fork is lowered but prohibit the flow of hydraulic fluid from the hydraulic lift cylinder to the hydraulic pump/motor at the time when the fork is stopped or raised;

a second fluid passage branched from a section of the first fluid passage between the hydraulic pump/motor and the outflow control mechanism, wherein the second fluid passage delivers hydraulic fluid delivered from the hydraulic lift cylinder to a drain side;

a flow control valve provided in the second fluid passage, wherein the flow control valve controls the flow rate of the hydraulic fluid delivered from the hydraulic lift cylinder to the hydraulic pump/motor and the flow rate of the hydraulic fluid delivered from the hydraulic lift cylinder to the drain side;

a loading hydraulic cylinder that receives or discharges hydraulic fluid through manipulation of a loading manipulation member to cause a loading member including the fork to perform loading operation other than raising or lowering of the fork;

a third fluid passage connected to the outlet port of the hydraulic pump/motor to deliver hydraulic fluid discharged by the hydraulic pump/motor to the loading hydraulic cylinder;

an opening/closing mechanism provided in a section of the first fluid passage between the hydraulic pump/motor and the outflow control mechanism, wherein the opening/closing mechanism switches the first fluid passage between an open state for allowing hydraulic fluid to flow through the first fluid passage and a closed state for prohibiting hydraulic fluid from flowing through the first fluid passage; and a controller for controlling a rotating electrical machine for driving the hydraulic pump/motor and controlling the opening/closing mechanism, wherein, when the fork is lowered through an independent operation, the controller controls the opening/closing mechanism to switch to the open state such that the hydraulic fluid delivered from the hydraulic lift cylinder drives the hydraulic pump/motor as a hydraulic motor to cause the rotating electrical machine to perform regenerative operation.

6. The hydraulic control apparatus for a forklift according to claim 5, wherein when simultaneous operation is performed in which the fork is lowered and the loading member is caused to carry out the loading operation, the controller drives the rotating electrical machine based on a necessary rotation speed of the hydraulic pump/motor necessary for performing operation at an instructed speed corresponding to a manipulation amount of the loading manipulation member and controls the opening/closing mechanism to switch to the closed state, and the opening/closing mechanism in the closed state causes the flow control valve to deliver the hydraulic fluid delivered from the hydraulic lift cylinder to the drain side.

* * * * *